US005509224A

United States Patent [19]

Roy

[11] Patent Number: 5,509,224

[45] Date of Patent: Apr. 23, 1996

[54] PERSONAL IDENTIFICATION NUMBER SHIELD

[75] Inventor: Elizabeth Roy, Santa Monica, Calif.

[73] Assignee: J. T. Martin, Washington, D.C.; a part interest

[21] Appl. No.: 408,572

[22] Filed: Mar. 22, 1995

[51] Int. Cl.[6] ..... G09F 21/02

[52] U.S. Cl. ..... 40/586

[58] Field of Search ..... 40/538, 586, 639; 63/1.1, 2, 15, 15.8; 109/24.1, 38; 116/137 R, 139, DIG. 44; 446/327, 328, 329, 473

[56] References Cited

U.S. PATENT DOCUMENTS

| | | | |
|---|---|---|---|
| 727,572 | 5/1903 | Bauer | 116/235 |
| 2,611,902 | 9/1952 | Rockmore | 116/139 |
| 2,637,939 | 5/1953 | Polk | 446/327 |
| 2,782,748 | 2/1957 | Zegarowitz | 116/137 R |
| 2,876,935 | 3/1959 | Lindberg | 116/DIG. 44 |
| 4,009,521 | 3/1977 | King et al. | 35/8 R |
| 4,667,087 | 5/1987 | Quintana | 235/380 |
| 5,273,607 | 12/1993 | O'Scanlon | 446/473 X |

FOREIGN PATENT DOCUMENTS

| | | | |
|---|---|---|---|
| 1502730 | 10/1967 | France | 40/586 |
| 1562158 | 2/1969 | France | 40/586 |

*Primary Examiner*—William A. Cuchlinski, Jr.
*Assistant Examiner*—Willie Morris Worth

[57] ABSTRACT

A shield that is substantially planar and pliant, and includes at least two substantially parallel slits provided in the shield into which the fingers of one hand of the user may be inserted so as to wrap around the portion of the shield between those slits and retain the shield in a position to obscure visual access to the information the user wants to shield from view.

4 Claims, 1 Drawing Sheet

PERSONAL IDENTIFICATION NUMBER SHIELD

SUMMARY

I have invented a shield that will allow its user to obscure visual access to the users personal identification number at a bank's automated teller machine, a public telephone, or the combination for any combination lock, such as the combination locks used on doors to automobiles, homes, apartments and the like. The shield is substantially planar and pliant, and includes two substantially parallel slits provided in the shield into which the fingers of one hand of the user may be inserted so as to wrap around the portion of the shield between those slits and retain the shield in a position to obscure visual access to the information the user wants to shield from view.

DETAILED DESCRIPTION

In response to a growing concern for security, I have invented a means to shield confidential information from view. Theft of personal identification number information has been growing to alarming proportions. Individual depositors have suffered unauthorized withdrawals from their bank accounts be persons who have observed those depositors when they use their personal identification numbers to withdraw funds at automated teller machines. Holders of telephone credit cards have been observed when making telephone calls from public telephones using their personal identification numbers to access the telephone system. Reports have appeared in newspapers that much theft of such information takes place from great distances by use of binoculars.

The need for security from such theft has arisen recently. I know of no prior art that discloses a simple and inexpensive means to provide such security. I have created a shield that provides that security. My shield 1 is substantially planar and pliant, and may be made out of a light weight material such as cardboard. The shield can be cut or stamped in any desired form, such as the form of a bat or butterfly. The shield should be provided with some means by which it can be held during use, preferably with the fingers of the same hand that is being used to select and depress the number buttons that correspond to the numbers of the users personal identification number assigned by the bank, telephone company or the like.

Figure 1:
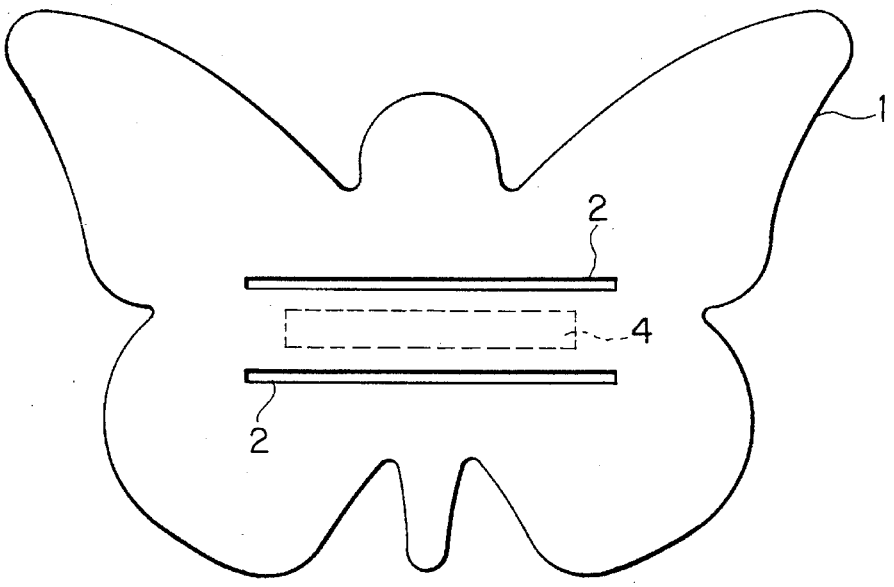
FIG. 1 is a two dimensional view of one form of my shield.
Figure 2:
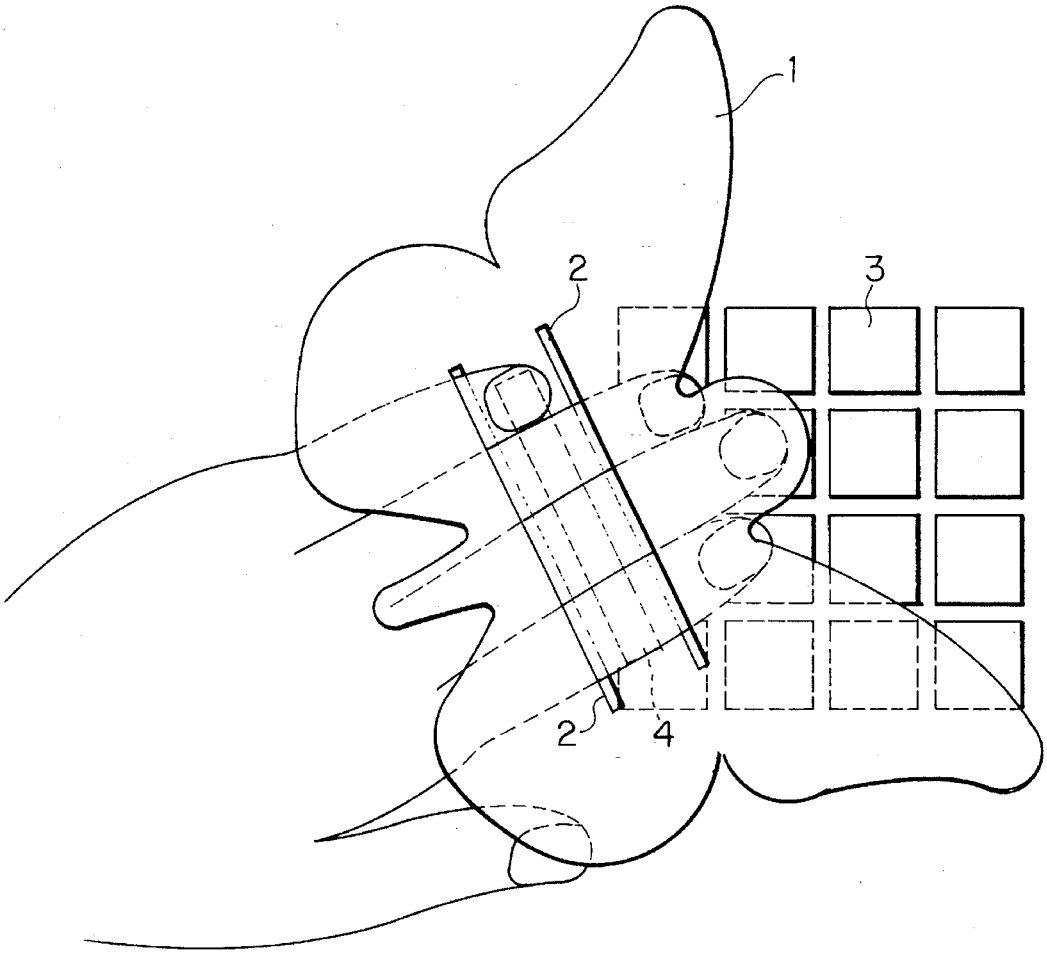
FIG. 2 is a perspective view of the same form of my shield, showing the fingers of a user inserted into my shield to a position in which the user can use my shield for its intended purpose.

I have chosen to provide my shield with at least two substantially parallel slits 2 into which the fingers of one hand of the user can be inserted as shown in FIG. 2. The two substantially parallel slits 2 may be spaced apart approximately one inch, or the width of the third joint of the second finger of an average hand. The fingers of that hand are inserted into the first slit and continue on through that first slit to the second slit, and are successively inserted into the second slit. If extended through the second slit to the point where the second joint of the fingers bend at the approximate location of that second slit, the fingers are free to select and depress the number buttons 3 that correspond to the personal identification number assigned to the user by the bank, telephone company or the like, while at the same time the third joint of those fingers hold the shield in place during the selection and depression of those buttons.

One of the reasons I prefer to use cardboard for my shield is because it receives and retains printers ink. The bank that provides an automated teller machine for use by its depositors may also find it beneficial to provide security for those depositors during their use of that machine. If so, that bank may choose to print its logo or trademark on the shield, along with a message to the user, and provide several of the shields at the locations of its automated teller machines. In that way, the bank can create goodwill among its depositors and deliver its competitive message to whomever sees its shields. The printed shields can be made so inexpensively that they can be provided to depositors free of charge at the location of each automated teller machine, and discarded by the depositor after each use or retained by the depositor for reuse elsewhere.

A slightly more expensive shield could be provided with an alarm 4 capable of sending an audible signal if squeezed by the user. Such an alarm preferably would be attached to the portion of the shield located between the two slits, in a position to be squeezed by the user by simply tightening the user's fingers into a fist from the position of normal use of the shield as shown in FIG. 2. Several alarms having the necessary size and shape are available on the market, and any one of those alarms may be selected and attached to the shield by any satisfactory method of attachment, such as an adhesive.

I have sought to describe the best form of my invention to those who read this patent. However, my shield can be manufactured and used in several forms, and I intend to protect the spirit of my invention in all of its various forms.

I claim:

1. A shield for obscuring visual access to information that consists of a substantially planar and pliant means of a size and shape adequate to obscure visual access to information through which at least two substantially parallel slits have been provided to form a retention portion of said means around which the fingers of a hand of the user may be wrapped to retain said shield while the user is obscuring visual access to information with said shield.

2. A shield as described in claim 1 in which said means is made of cardboard.

3. A shield as described in claim 1 in which said means includes information printed on a portion of a surface of said means.

4. A shield as described in claim 1 in which said means is made of cardboard and includes information printed on a portion of a surface of said cardboard means.

* * * * *